United States Patent [19]

Bell

[11] Patent Number: 5,038,927

[45] Date of Patent: Aug. 13, 1991

[54] DISPLAY CASE FOR CARD-MOUNTED MERCHANDISE

[76] Inventor: Robert J. Bell, P.O. Box 2035, North Conway, N.H. 03860

[21] Appl. No.: 521,757

[22] Filed: May 10, 1990

[51] Int. Cl.[5] ..... B65D 5/50

[52] U.S. Cl. ..... 206/45.14; 206/6.1; 206/45.34; 206/806; 211/7; 211/13; 211/194; 312/60; 312/184; 312/185

[58] Field of Search ..... 206/44 B, 45.14, 45.31, 206/45.34, 485, 6.1, 806, 583; 211/13, 163, 188, 194, 4, 7; 312/50, 60, 184, 185

[56] References Cited

U.S. PATENT DOCUMENTS

| | | | |
|---|---|---|---|
| 2,079,177 | 5/1937 | Membrino | 206/45.34 |
| 2,274,196 | 2/1942 | Gilbert | 206/45.34 |
| 2,802,565 | 8/1957 | Kabbash | 206/45.34 |
| 2,974,825 | 3/1961 | Ross | 206/45.34 |
| 3,131,809 | 5/1964 | Rudes | 206/45.34 |
| 3,206,014 | 9/1965 | Blumberg | 206/45.34 |
| 3,252,567 | 5/1966 | Baron et al. | 206/45.31 |
| 3,532,209 | 10/1970 | Del Bonis | 206/45.34 |
| 3,650,382 | 3/1972 | Braun et al. | 206/45.14 |
| 3,747,830 | 7/1973 | Goldman | 206/45.34 X |
| 3,938,665 | 2/1976 | Rumble | 211/4 |
| 4,155,457 | 5/1979 | Wilbert | 211/4 |
| 4,322,007 | 3/1982 | Feibelman | 211/163 |
| 4,442,942 | 4/1984 | Cumirale et al. | 211/163 |
| 4,552,264 | 11/1985 | Quarrell et al. | 206/45.14 |
| 4,753,340 | 6/1988 | Blakeman et al. . | |

FOREIGN PATENT DOCUMENTS

| | | | |
|---|---|---|---|
| 2032156 | 1/1972 | Fed. Rep. of Germany | 206/45.34 |

*Primary Examiner*—Bryon P. Gehman
*Attorney, Agent, or Firm*—Michael J. Weins

[57] ABSTRACT

The present invention is a display case designed to show small objects which are suitable for card mounting. The case has a transparent conduit with a closed end and an open end. Cards on which jewelry or other merchandise is mounted are inserted into the conduit through the open end.

In one preferred embodiment a clip having a slot is employed to hold the cards. In another preferred embodiment a second spaced apart slot is provided for insertion of a second set of cards which doubles the display capacity.

Support for the card array is provided in one embodiment by one or more protrusions extend into the tube on which the card array rests. These protrusions extend into the tube and provide maximum distance to the wall of the tube which is less than the width of the card array. The protrusions provide support for the vertical array of cards and can be indentations in the wall of the tube.

In another embodiment of the invention a rod passing through the wall of the tube is employed as the support the vertical array of cards. Lockable caps are preferably employed to hold the rod in position.

A hanger is provided which attaches to the closed end of the conduit to allow the display case to be hung eliminating the need for counter space. It is preferred that the hanger is rotatably mounted so that the display case can be rotated.

19 Claims, 2 Drawing Sheets

DISPLAY CASE FOR CARD-MOUNTED MERCHANDISE

FIELD OF INVENTION

The present invention is for a display case, and in particular for a case which displays merchandise which is card-mountable such as jewelry.

BACKGROUND ART OF THE INVENTION

Small merchandise such as jewelry is frequently displayed at a point of purchase display. A point of purchase display is defined as a display in the vicinity of the checkout counter. A point of purchase display will place the merchandise at the place where other purchases are being made and frequently will result in an impulse sale of the merchandise displayed. There are a variety of display cases currently employed. Glass-faced cabinets beneath the checkout counter are frequently employed to display merchandise at the point of purchase. However, such displays do not present the merchandise at eye level and for small objects, such as jewelry, the merchandise may be missed.

Card displays have also been used for jewelry and other small merchandise. The jewelry is mounted on cards which are displayed on racks which are placed on the checkout counter. Such displays require counter-space which is limited and thus limits the display. Furthermore, the cards can be easily removed from the racks making the jewelry or other merchandise so displayed subject to shoplifting. Thus there is a need for a display case that will not require the use of counter space and will provide a degree of protection against shoplifting.

BRIEF SUMMARY OF INVENTION

It is an object of the present invention to provide a display case which is designed for the point of purchase.

It is another object of the invention to provide an eye level display.

A further object of the present invention is to provide a display which does not require counterspace.

It is still a further object of the present invention to provide a display suitable for showing jewelry mounted on cards.

Yet another object of the present invention is to provide a display that will discourage shoplifting.

These and other objects will become apparent from the following description, drawings and claims.

The display case of the present invention is designed to show small objects, such as jewelry, which can be mounted on cards. The case has a transparent conduit of length L and has a cross section with a maximum dimension D. In a preferred embodiment the conduit is a cylindrical tube. The conduit has a closed end and an open end. Cards on which jewelry or other merchandise is mounted are inserted into the conduit through the open end.

Means for holding the cards in a vertical array are provided. The means for holding the cards has an overall length l which is less than the overall length L of the conduit. This means for holding the cards will hold a vertical array of cards of length l. The width W of the array of card with the means for holding the cards attached must be less than the maximum dimension of the cross section of the conduit. In the case where the conduit is a tube then the width W must be less than the diameter of the tube.

Preferably the means for holding the cards is a clip having a slot into which the cards will slidably engage. In one preferred embodiment a second spaced apart slot is provided for insertion of a second set of cards and in this way a doubling of the display capacity of the display case is achieved.

A support means for the card array is provided at a distance greater than l from the closed end of the tube. One preferred support means for a cylindrical tube is a protrusion extending into the tube. This protrusion extends into the tube and provides maximum distance to the wall of the tube which is less than the width (W) of the card array including the means for holding the cards attached. The protrusion provides support for the vertical array of cards and can be an indentation in the wall of the tube. It is preferred that a second protrusion be provided in the tube which is diametrically opposed to the first protrusion so as to provide an additional support for the vertical array of cards.

A hanger is provided which attaches to the closed end of the conduit to allow the display case to be hung. Hanging the display case eliminates the need for counter-space. It is preferred that the hanger is rotatably mounted so that the display case can be rotated.

BEST MODE FOR CARRYING THE INVENTION INTO PRACTICE

Figure 1:
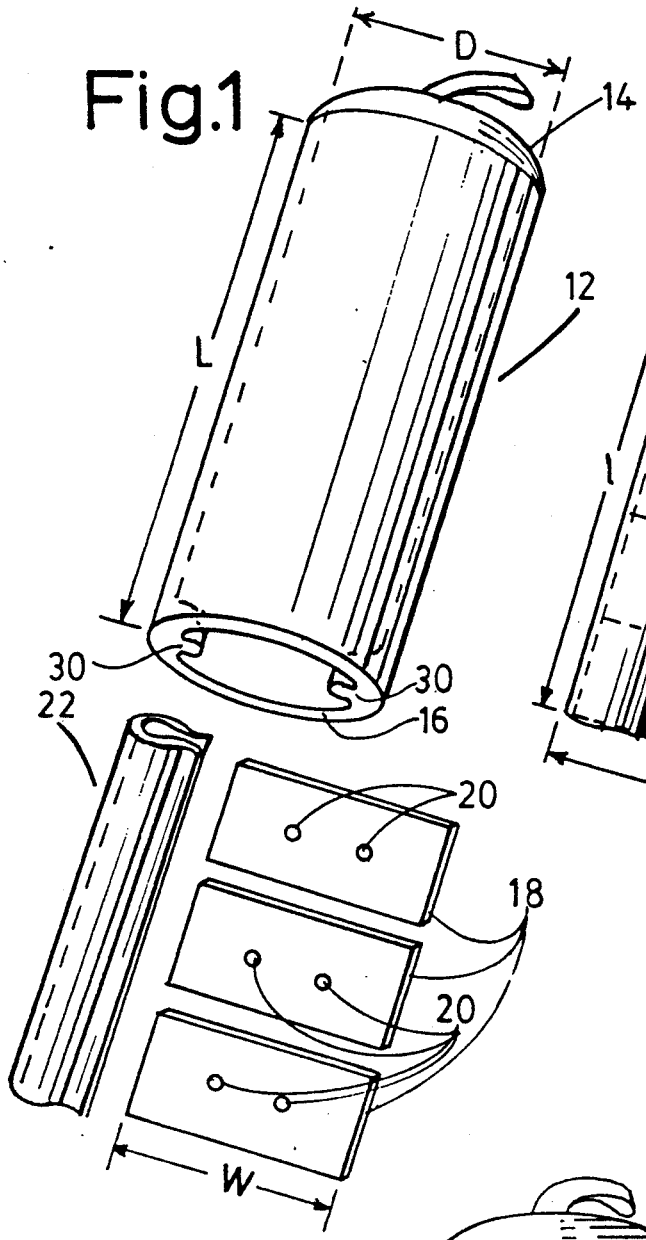
FIG. 1 is an exploded view of one embodiment of the display case of the present invention illustrating the various components.

FIG. 1 is an exploded view of one embodiment of the display case 10 of the present invention. A tube 12 having a diameter D and an overall length L serves as a conduit. The tube 12 has a closed end 14 and an open 16. The tube 12 forms the body of the display case 10. Cards 18 having a width w, which is less than the diameter D of the tube 12, are employed to mount merchandise such as jewelry 20 thereon. The cards 18 attach to a card holding means 22.

Figure 2:
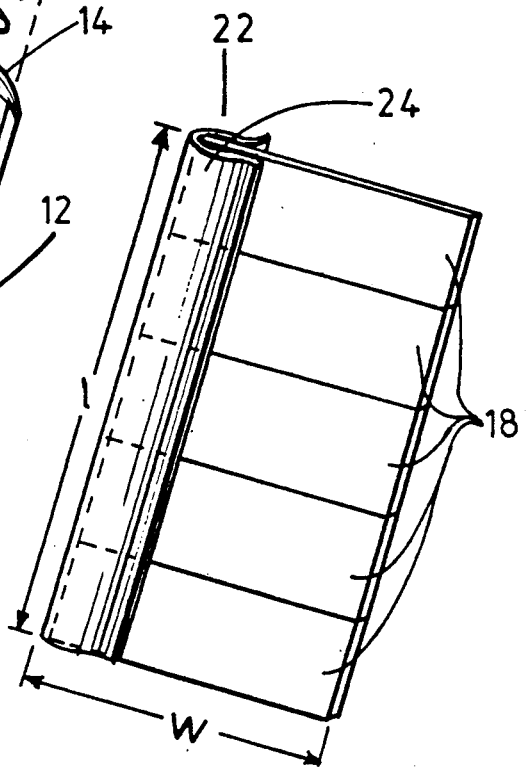
FIG. 2 shows one embodiment of a means for holding a card to form a card array.

FIG. 2 shows a clip 24 which serves as the holding means 22 for the display of FIG. 1. The cards 18 are held by the clip 24 providing a vertical array of cards 28. The clip 24 has an overall length l which is less than the length L of the tube. The clip 24 will support a vertical array of cards 18 of length l. The cards 18 when affixed to the clip 24 must have an overall array width W which includes the cards 18 and clip 24 which is less than the diameter D of the tube 12 into which the array of cards is placed.

The support means for the embodiment of FIG. 1 employs at least a first protrusion 30 which is directed into the tube 12. The protrusion 30 is positioned at a distance greater than the clip length l from the closed end 14 of the tube 12. Having the protrusion 30 so positioned provides sufficient space for the vertical array 28 of cards 18 to rest on the protrusion 30 without the vertical carry array 28 impinging the closed end 14. When the vertical card array 28 is aligned with the protrusion 30, the protrusion 30 will support the vertical card array 28.

Figure 3:
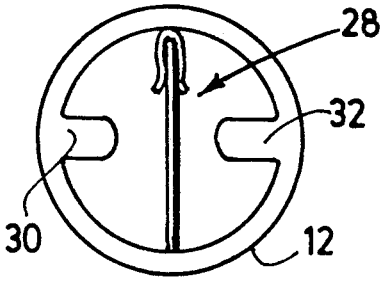
FIG. 3 is a bottom view of the assembled display case of FIG. 1 with the card array on which the jewelry is mounted positioned such that the card array can be inserted or removed.

FIG. 3 shows the bottom view of the tube 12 of FIG. 1. In this embodiment a first protrusion 30 and a second protrusion 32 are provided. The second protrusion 32 is diametrically opposed to the first protrusion 30. The vertical array 28 of cards 18 can be inserted into the tube 12 by positioning the vertical array 28 so that it passes between the protrusions 30 and 32.

Figure 4:
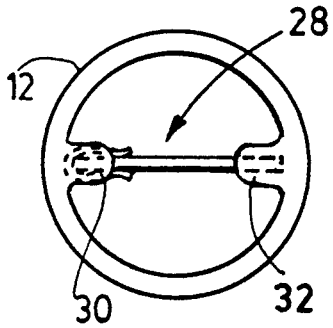
FIG. 4 is the bottom view of FIG. 2 where the card array is mounted such that the card array is locked in position.

FIG. 4 shows the vertical array 28 installed in the tube 12 and positioned over the protrusions 30 and 32 which supports the vertical array 28 of the cards 18 in the tube 12. It is further preferred that the vertical array 28 slidably engages the tube 12 to maintain the vertical array 28 in position above the protrusions 30 and 32 thereby avoiding shifting of the vertical array 28 off the protrusions 30 and 32.

Figure 5:
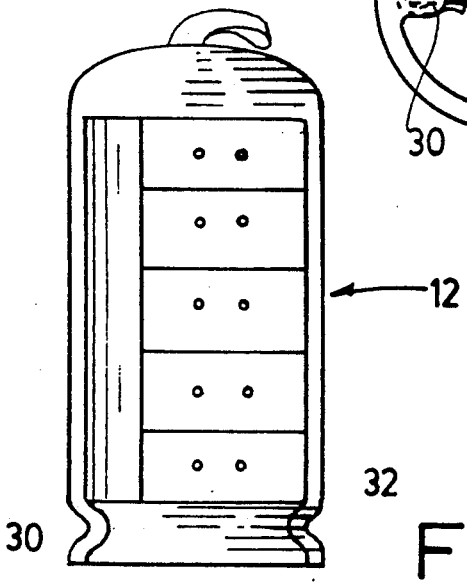
FIG. 5 illustrates a second embodiment of the present invention showing an assembled display case where the protrusions into the tube are made by the indentation of the wall of the tube.

FIG. 5 illustrates a tube where the protrusions 30 and 32 which hold the vertical array 28 in position are indentations in the wall of the tube 12.

The depressions in the surface of the tube produce protrusions 30 and 32 which extend into the tube 12 and extend over a substantial portion of the periphery of the tube. These broad protrusions reduce the chance of the vertical card array 28 from sliding off the protrusions 30 and 32.

Figure 6:
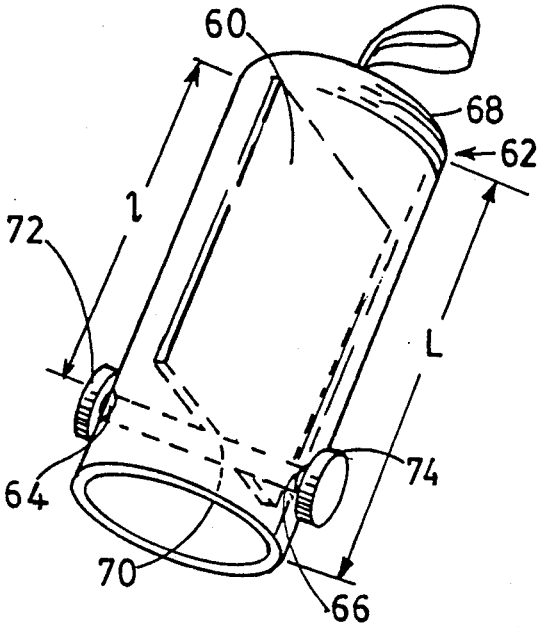
FIG. 6 illustrates another embodiment having a means for supporting the card array which is lockable.

FIG. 6 illustrates another embodiment of the means for supporting a card array 60 in a tube 62. The tube 63 has diametrically opposed passages 64 and 66 which are positioned at a distance greater than length l from the closed end 68 of the tube 62. A rod 70 supports the card array 60.

End caps 72 and 74 are attached to the rod 70 in the tube 62. Preferably the caps 72 and 74 have key locks which secure the rod which makes the case openable only to those having a key so as to eliminate theft from the display case.

Figure 7:
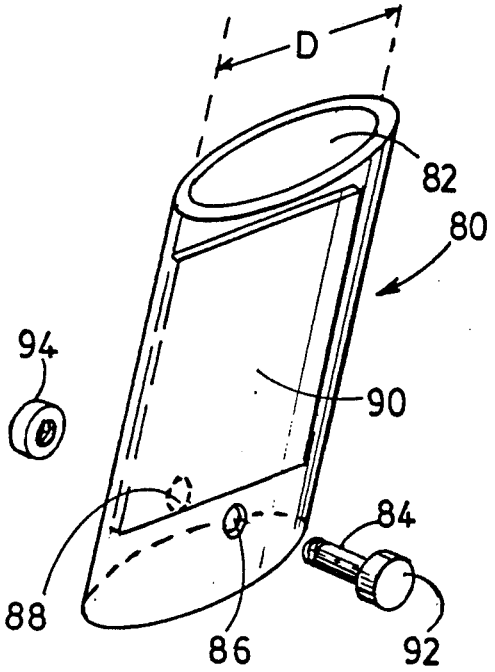
FIG. 7 illustrates another embodiment of the invention employing a non-circular conduit.

FIG. 7 illustrates another embodiment of the present invention where the conduit 80 has an elliptical cross section 82 with a maximum dimension D. In this embodiment a rod 84 passes through passage 86 and 88 and supports the card array 90. Locking caps 92 and 94 secure the rod 84 in the conduit 80.

Figure 8:
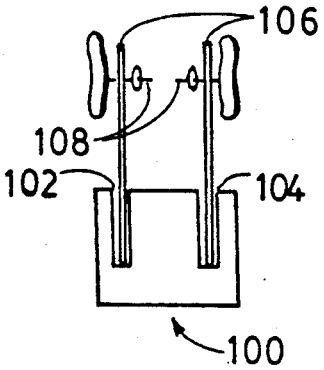
FIG. 8 illustrates a clip for holding cards which has two spaced-apart slots for holding the two sets of cards.

FIG. 8 illustrates a clip 100 with a first slot 102 for holding a first array of cards and a second slot 104 spaced-apart for holding a second array of cards. The dual slot allows two sets of jewelry to be displayed where the jewelry extends through the cards having substantial extensions on the back of the card such as the posts 108 of pierced earrings. In this case, the separation between the two slots is such that the cards 106 will be separated at a distance greater than the earring posts 108.

Figure 9:
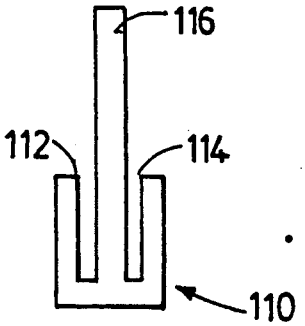
FIG. 9 illustrates a second two-slot configuration clip to allow back-to-back mounting of cards for display of jewelry.

FIG. 9 illustrates an alternate two-slot card clip 110. The first slot 112 and the second slot 114 have there between a card support member 116 that allows cards to be placed back-to-back and slipped into and out of the slots 112 and 114 without effecting the cards which are behind the card being removed.

Figure 10:
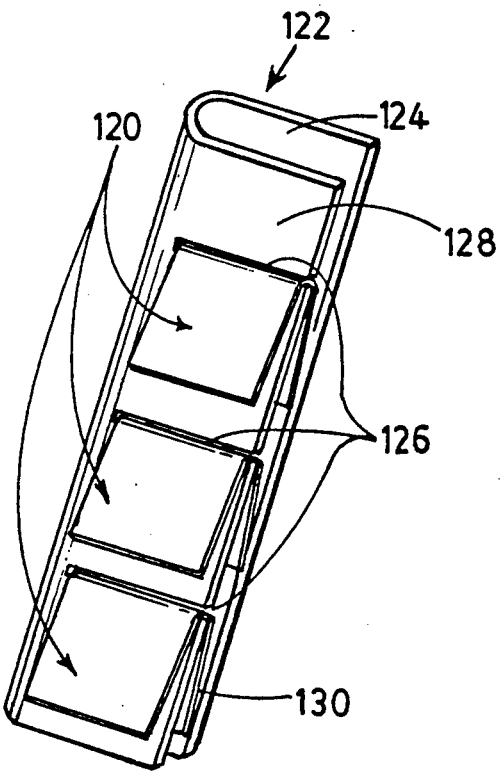
FIG. 10 illustrates a clip for holding folded cards.

FIG. 10 illustrates a card clip for jewelry which is mounted on folded cards 120. The clip 122 has a central slot 124. Slits 126 are provided in side 128 of the clip 122. The slits 126 permits the cards 120 to be mounted with a first leg 130 of the card 120 in the slot 124 while the second leg 132 is outside the slot 124.

While the preferred embodiment of the invention has been described, it should be apparent to one having ordinary skill in the art that many modifications or changes may be made in the preferred embodiment without departing from the spirit of the present invention as expressed by the scope of the appended claims.

What I claim is:

1. A display case for card mounted merchandise comprising:

a transparent tube having a length L and a cross section with internal diameter D, said tube having a closed end and an open end;

a clip having at least a first slot for holding an array of cards, said clip engaging said transparent tube, said clip having a length l less than said length L of said tube and an array of cards with said clip attached thereto having a combined width W less than the internal diameter D of said tube;

at least one protrusion for support of said array of cards extending into said tube attaching to said tube at a distance greater than the length l from said closed end of said tube and;

a hanger attached to said closed end of said tube for suspending the display case.

2. The display case of claim 1 wherein two protrusions are employed for support of said array of cards.

3. The display case of claim 2 wherein said clip has a second slot, said second slot spaced apart from said first slot.

4. The display case of claim 3 wherein said clip further comprises a divider positioned between said first slot and said second slot.

5. The display case of claim 2 wherein said hanger is rotatably mounted in said first end.

6. The display case of claim 2 wherein said tube has an outer surface which has indentations providing said protrusions.

7. The display case of claim 2 wherein said clip has a side with slits contoured therein.

8. A display case for card mounted merchandise comprising:

a transparent conduit having a length L and a cross section with a maximum opening dimension D, said conduit having a closed end and an open end;

means for holding an array of cards which engages said transparent conduit, said means for holding an array of cards having a length l less than said length L of said conduit, said array of cards with said means for holding an array of cards attached thereto having a combined width W less than the maximum opening dimension D of said cross section of said conduit;

a rod for support of said array of cards;

passages located in said conduit positioned such that when said rod is positioned into said passages, said rod is at a distance greater than the length l from said closed end of said conduit; and a hanger attached to said closed end of said conduit for suspending the display case.

9. The display case of claim 8 wherein said means for holding an array of cards is a clip having at least a first slot for holding an array of cards, and further wherein a locking means for locking said rod to said conduit are provided which attach to said rod.

10. The display case of claim 9 wherein said clip has a second slot, said second slot spaced apart from said first slot.

11. The display case of claim 10 wherein said clip further comprises a divider positioned between said first slot and said second slot.

12. The display case of claim 11 wherein said hanger is rotatably mounted in said closed end.

13. The display case of claim 9 wherein said hanger is rotatably mounted in said first end.

14. The display case of claim 8 wherein said transparent conduit is a tube having a cross section and an internal diameter D and further wherein said means for holding the array of cards is a clip having at least a first slot.

15. The display case of claim 14 wherein said clip has a side with slits contoured therein.

16. The display case of claim 15 wherein locking means for locking said rod in said tube are provided which attach to said rod.

17. A display case for card mounted merchandise comprising:

a transparent conduit having a length L and a cross section with a maximum opening dimension D said conduit having a closed end and an open end;

means for holding an array of card which engages said transparent conduit, said means for holding an array of cards having a length l less than said length L of an conduit, said array of cards with said means for holding an array of cards attached thereto having a combined width W less than the maximum opening dimension D of said cross section of said conduit;

at least one protrusion for support of said array of cards extending into said conduit, said at least one protrusion attaching to said conduit at a distance greater than the length l from said closed end of said conduit; and a hanger attached to said closed end of said conduit for suspending the display case.

18. The display case of claim 2 wherein two protrusions are employed for support of said array of cards.

19. The display case of claim 18 wherein said conduit has an outer surface which has indentations providing said protrusions.

* * * * *